US007264191B2

(12) United States Patent
Gerl

(10) Patent No.: US 7,264,191 B2
(45) Date of Patent: Sep. 4, 2007

(54) AGITATOR MILL

(75) Inventor: Stefan Gerl, Werbach (DE)

(73) Assignee: Maschinenfabrik Gustav Eirich GmbH & Co. KG, Hardheim (DE)

( * ) Notice: Subject to any disclaimer, the term of this patent is extended or adjusted under 35 U.S.C. 154(b) by 393 days.

(21) Appl. No.: 10/918,369

(22) Filed: Aug. 16, 2004

(65) Prior Publication Data

US 2005/0040266 A1 Feb. 24, 2005

(30) Foreign Application Priority Data

Aug. 22, 2003 (EP) ..... 03019033

(51) Int. Cl.
*B02C 17/16* (2006.01)

(52) U.S. Cl. ..... 241/171; 241/172

(58) Field of Classification Search ..... 241/57, 241/171, 172, 176, 65, 66, 101.3
See application file for complete search history.

(56) References Cited

U.S. PATENT DOCUMENTS 2,651,582 A * 9/1953 Courtney ..... 106/167.01
4,854,715 A * 8/1989 Eirich et al. ..... 366/139
4,998,678 A 3/1991 Eirich et al.
5,361,996 A * 11/1994 Svensson et al. ..... 241/30

FOREIGN PATENT DOCUMENTS

EP 0 369 149 10/1989
EP 1 323 476 A1 12/2002

* cited by examiner

*Primary Examiner*—Shelley M. Self
(74) *Attorney, Agent, or Firm*—Browdy and Neimark PLLC

(57) ABSTRACT

An agitator mill comprises a grinding receptacle and a rotarily drivable agitator arranged therein. A grinding-stock supply mouthes into the grinding chamber; a grinding-stock discharge leads out of the grinding chamber. The grinding chamber is at least partially filled with auxiliary grinding bodies. The grinding-stock discharge is embodied as a device for grinding stock suction and auxiliary-grinding-body separation, comprising a plunge pipe which dips into a bed of grinding stock and auxiliary grinding bodies and from which, above the grinding receptacle, discharges a suction pipe with a grinding-stock suction device.

13 Claims, 2 Drawing Sheets

AGITATOR MILL

BACKGROUND OF THE INVENTION

1. Field of the Invention

The invention relates to an agitator mill comprising a grinding receptacle, which encloses a grinding chamber of a diameter D, which is closed downwards by a bottom, and which has a top cover and a vertical central longitudinal axis; an agitator, which has an agitator axis that is parallel to the central longitudinal axis, and which is equipped with agitator implements inside the grinding chamber; an agitator drive for rotary actuation of the agitator about the agitator axis; a grinding-stock supply which discharges into the grinding chamber; a partial filling of the grinding chamber with auxiliary grinding bodies of a diameter b which are movable in a bed of grinding stock and auxiliary grinding bodies in a direction of flow; and a device for grinding-stock suction and auxiliary-grinding-body separation, which leads out of the grinding chamber, which comprises a plunge pipe of an inside diameter d, which, by a bottom inlet, dips into the bed of grinding stock and auxiliary grinding bodies and from which a suction pipe discharges above the grinding receptacle, having a grinding-stock suction device.

2. Background Art

An agitator mill of the generic type is known from U.S. Pat. No. 4,998,678; it comprises a rotarily drivable grinding receptacle, with a seal that serves as a splash guard being provided between the grinding receptacle and a cover which is non-rotatably mounted on the machine stand, serving as a lid. These agitator mills cannot be operated at overpressure. Grinding-stock discharge is pressureless i.e., it takes place against atmospheric pressure.

In practice, numerous approaches towards separation of the auxiliary grinding bodies from the grinding stock after a grinding job have been made and published. Using screens and screen cartridges has become a familiar approach; however, they bear the risk of clogging and have a restricted surface. Providing rotary separating devices has also been known; they are comparatively complicated, tending to wear off in particular with abrasive grinding stock.

U.S. Pat. No. 2003/011663 A1 teaches an agitator mill of a design similar to the above, with the grinding-stock/auxiliary-grinding-body separating device being embodied in such a way that a plunge pipe is placed on an agitating disk with a gap being left through which to suck grinding stock. Such a design too tends to comparatively strong wear.

SUMMARY OF THE INVENTION

It is an object of the invention to embody an agitator mill of the generic type in such a way that separating the auxiliary grinding bodies is put into practice in a solid design, demanding but for minor constructional requirements.

According to the invention, this object is attained in that the plunge pipe, at its inlet, comprises a recess which—related to the direction of flow—is formed on the downstream side of the plunge pipe; and in that an area of the plunge pipe which—related to the direction of flow—is located on the upstream side of the plunge pipe in direct vicinity to the inlet shields the recess in the direction of flow. The gist of the invention resides in that the mixture of grinding stock and auxiliary grinding bodies is sucked out of the agitator mill by way of a plunge pipe after the grinding process, segregation of the auxiliary grinding bodies taking place within the plunge pipe by weight and inertia. By reason of gravity and entrained by the bed of auxiliary grinding bodies that passes below the plunge pipe, the auxiliary grinding bodies directly return into the grinding chamber. This can be put into practice very easily and at a low cost. The components that are used can be protected from wear very easily and at almost no expense. Even tiny auxiliary grinding bodies can be segregated.

The agitator mill according to the invention is preferably employed for grinding substances that will cause strong wear in the agitator mill. They are in particular ceramic substances which are blended with water, forming a comparatively low-viscosity slush of a grinding stock. Grinding stock of this kind is of comparatively inferior value, restricting the cost of wear per unit of weight of the grinding stock. As a result of the embodiment according to the invention, the agitator mill can be safely operated for a long time at almost no wear, which cannot be said for other auxiliary-grinding-body separating devices. The design according to the invention permits the auxiliary grinding bodies to sediment from the grinding stock in the vicinity of the device for grinding-stock suction and auxiliary-grinding-body separation. A sort of a pocket forms in the plunge pipe within the bed of auxiliary grinding bodies, holding no or only very few auxiliary grinding bodies which may rise in the plunge pipe together with the grinding stock.

The invention can in particular be used to advantage when the grinding receptacle too is rotarily drivable, enforcing a flow of auxiliary grinding bodies in the grinding chamber. As a result of the eccentric arrangement of the plunge pipe, the auxiliary grinding bodies which sink downwards in the plunge pipe are entrained by the rotating bed of grinding stock and auxiliary grinding bodies, the plunge pipe mouthing into a grinding-chamber area of high-intensity motion of the bed of grinding stock and auxiliary grinding bodies, which is still supported by the eccentric arrangement of the at least one agitator and in particular by the arrangement of the plunge pipe.

Further features, advantages and details of the invention will become apparent from the ensuing description of an exemplary embodiment, taken in conjunction with the drawing.

DESCRIPTION OF A PREFERRED EMBODIMENT

Figure 1:
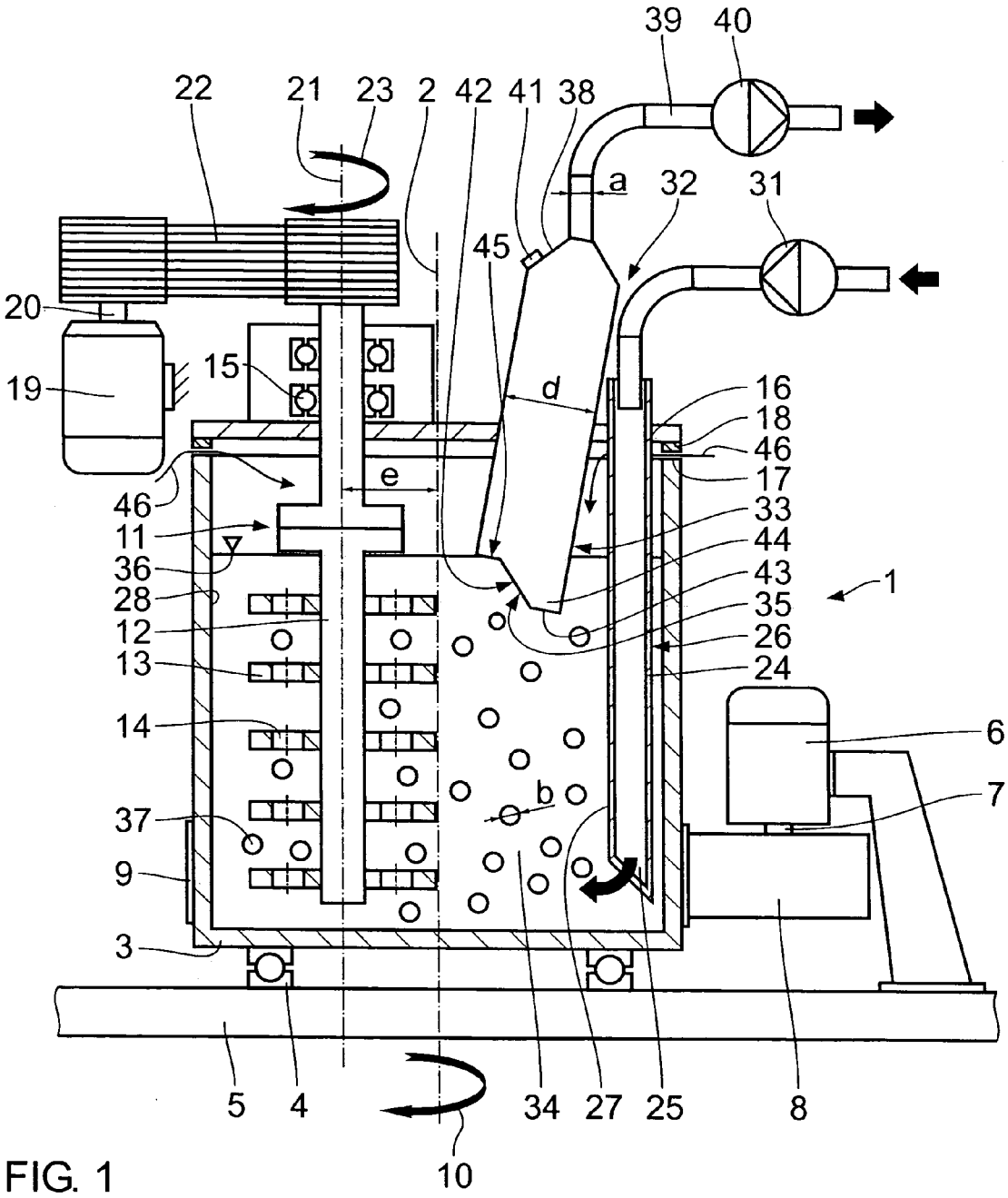
FIG. 1 is a view of a vertical central longitudinal section of an agitator mill.
Figure 2:
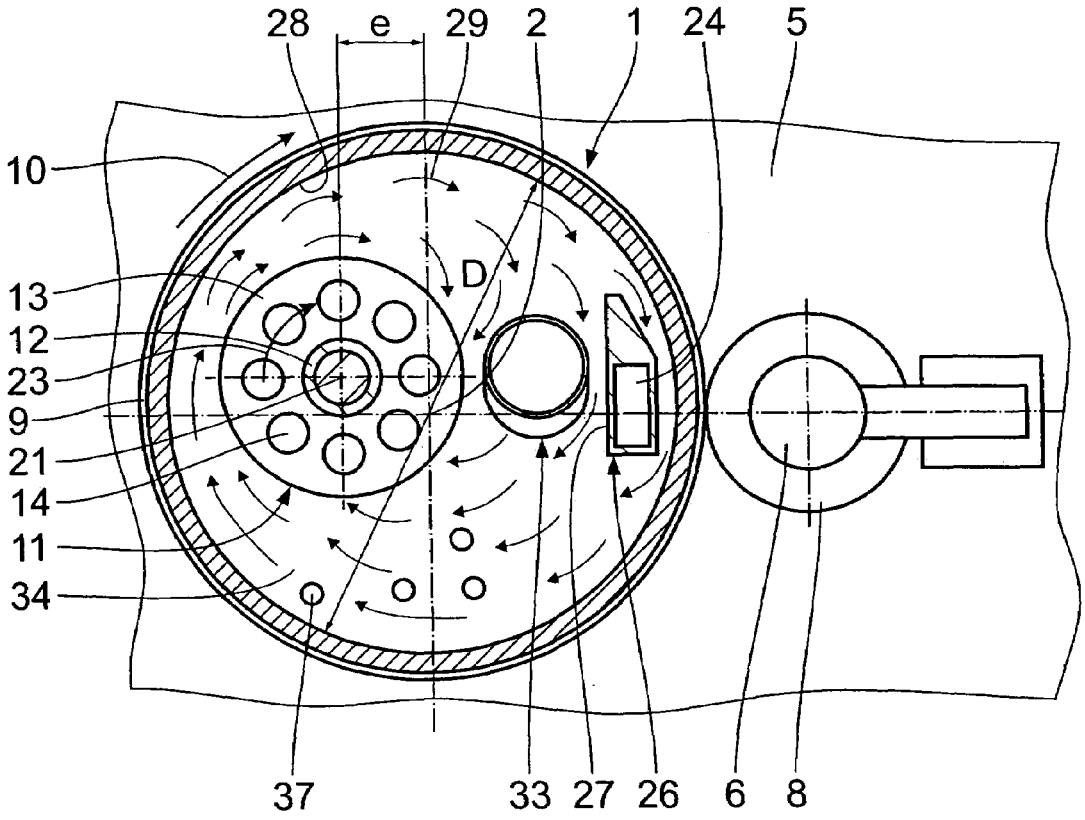
FIG. 2 is a horizontal cross-sectional view of the agitator mill of FIG. 1.

The agitator mill seen in FIGS. 1 and 2 comprises a substantially circular cylindrical grinding receptacle 1, the central longitudinal axis 2 of which is vertical i.e., the grinding receptacle 1 is vertically upright. It is closed downwards by a bottom 3 that runs crosswise of the axis 2. By way of a rotary bearing 4 that is concentric of the axis 2, it supports itself on a machine stand 5 which is only roughly outlined, the grinding receptacle 1 thus being rotatable about the central longitudinal axis 2. A stand-5-supported grinding-receptacle driving motor 6 is provided as a rotary drive of the grinding receptacle 1; the shaft 7 of the motor 6 is parallel to the axis 2, driving the grinding receptacle 1 in the direction of rotation 10 by way of a gear drive 8 and a gear ring 9 which is mounted on the bottom periphery of the grinding receptacle 1. A corresponding reduction ratio of the gear drive 8 relative to the gear ring 9 enables the grinding receptacle 1 to be driven at a comparatively low speed. Of course, a wheel-and-disk drive may be used instead of a gear drive 8.

An agitator 11 is disposed in the grinding receptacle 1, substantially—and in this regard conventionally—comprising an agitator shaft 12 and agitator implements 13 that are disposed thereon and stand out radially. In the present case, the agitator implements 13 are agitating disks with passages 14. The top portion of the agitator shaft 12 that faces away from the bottom 3 is run on a bearing 15. This bearing 15 is mounted on a frontal cover 16 which is not rotatable and supports itself on the machine stand 5 in a manner not illustrated. Located between the cover 16 and the top edge 17 of the grinding receptacle 1 is a splash guard 18 which is concentric of the central longitudinal axis 2 of the grinding receptacle 1. The splash guard 18 is not joined to the edge 17 of the grinding receptacle 1, the grinding receptacle 1 being rotatable and the lid in the form of a cover 16 being stationarily, though removably mounted on the machine stand 5. The cover 16 and the splash guard 18 not closing the grinding receptacle 1 pressure-proof, atmospheric pressure will prevail in the grinding receptacle 1; air may penetrate into the grinding receptacle 1.

The agitator 11 is actuated by an agitator driving motor 19, which is connected to the machine stand 5 and the shaft 20 of which is parallel to the agitator axis 21, but displaced therefrom by an eccentricity e. A belt drive 22 provides for transmission of actuation to the agitator shaft 12. The driving motor 19 actuates the agitator 11 in the direction of rotation 23, which may be the same as the direction of rotation 10; however, the directions of rotation 10 and 23 may as well be opposite.

A grinding-stock supply line 24 leads through the non-rotary cover 16, there being secured; its outlet 25 is in vicinity of the bottom 3 of the grinding receptacle 1. In the embodiment seen, this line 24 is embodied in the form of a flow deflector 26. This deflector 26 can have a deflection surface 27, as a result of which any flow 29 of grinding stock and auxiliary grinding bodies (shown only in FIG. 2) that impinges thereon is deflected radially inwards. The line 24 is arranged in proximity to the wall 28 of the grinding chamber. A grinding-stock feed pump 31 supplies grinding stock to the supply line 24, the grinding stock being fed to the grinding receptacle 1 through the outlet 25 in the bottom area thereof i.e., in vicinity of the bottom 3.

A pressure-proof device 32 for grinding-stock suction and auxiliary-grinding-body separation passes from outside through the cover 16. It is designed in the form of a circular cylindrical plunge pipe 33 that projects into the grinding chamber 34 provided in the grinding receptacle 1. An inlet 35 is located at its bottom end inside the grinding chamber 34. The inlet 35 dips into the level 36 formed by the grinding stock and auxiliary grinding bodies 37 filling the grinding chamber 34. The plunge pipe 33 projects into the bed of grinding stock and auxiliary grinding bodies that is defined upwards by the level 36. At the top end outside the grinding chamber 34, the device 32 comprises a portion 38 that is closed all around, tapering in the shape of a funnel. A suction pipe 39 discharges upwardly therefrom, including a grinding-stock suction pump 40. The tapering portion 38 is further provided with a vibration exciter 41 that can set the device 32 vibrating.

As seen in FIG. 2, the plunge pipe 33 is disposed between the deflector 26 and the agitator 11 where there is strong compacting of the flow in the direction of flow 29. The substantially cylindrical plunge pipe 33 has a comparatively great inside diameter d of a dimensioning as permitted by the plunge pipe 33 at the place specified. In relation to the inside diameter D of the cylindrical grinding receptacle 1 i.e., in relation to the inside diameter D of the grinding chamber 34, the following applies: $10d \geqq D \geqq 4d$, with in particular $8D \geqq D \geqq 5d$. As seen in FIG. 1, the diameter d of the plunge pipe 33 distinctly exceeds the diameter a of the suction pipe 39. The diameter d of the plunge pipe 33 and consequently the diameter d of the inlet 35 considerably exceeds the diameter b of the biggest auxiliary grinding bodies 37 used, with $10b \leqq d$, and preferably $20b \leqq d$, applying. As for the diameter b of the auxiliary grinding bodies 37, $b \geqq 2.0$ mm applies. The diameter b of the fresh, non worn auxiliary grinding bodies 37 is in the range of 2 to 10 mm, preferably 4 to 7 mm. As a rule they are made of steel or—preferably—of ceramics such as $Al_2O_3$ or $ZrO_2$ or other suitable materials.

The bottom end, allocated to the inlet 35, of the plunge pipe 33 is provided with a recess 42 that is located inside the flow 29 of auxiliary grinding bodies seen only in FIG. 2. This is also where the recess 42 is shown in its correct position relative to the flow 29, whereas FIG. 1, for reasons of clarity, illustrates the plunge pipe 33, inclusive of the recess 42, in a position rotated by 90° about its longitudinal axis. Seen in the direction of flow 29, the recess 42 is located on the downstream side of the plunge pipe 33 so that, in relation to the flow 29, the recess 42 is covered or shielded by the bottom rear area 44 of the plunge pipe 33 that stretches as far as to the bottom rear edge 43. Consequently, no or only few auxiliary grinding bodies 37 arrive in the recess 42. In the vicinity of the recess 42, a certain clearance or free zone is produced below the level 36 in the plunge pipe 33, holding no or only very few auxiliary grinding bodies 37.

As seen in FIGS. 1 and 2, the plunge pipe 33 inclines counter to the direction of flow 29 of the grinding stock and the auxiliary grinding bodies 37 in such a way that, seen from top to bottom, the inlet 35, in the direction of flow 29, is in lead of the top end that comprises the tapered portion 38 and the suction pipe 39. In this way, the bottom edge 43 and the bottom rear area 44 of the plunge pipe 33 reaches even deeper into the bed of grinding stock and auxiliary grinding bodies below the level 36, the upper area 45 of the recess 42 being level therewith so that any air entering the grinding receptacle 1 in accordance with the arrow of flow direction 46 can as well be sucked into the plunge pipe 33 whenever the level 36 drops below the top edge of the recess 42.

The mode of operation is as follows:

Grinding stock in a pumpable condition i.e., as a rule in the form of slush, is supplied through the grinding-stock supply line 24 by the grinding-stock feed pump 31, so-called wet grinding taking place. The grinding chamber 34 holds a bed of auxiliary grinding bodies 37 in the form of the grinding chamber 34 being partially filled with auxiliary grinding bodies 37, which is defined upwards by a level 36. The agitator 11 is actuated in the direction of rotation 23; the grinding receptacle 1 is driven in the direction of rotation 10. The speeds are selected such that the bed of auxiliary grinding bodies 37 is maintained as a compact bed, the auxiliary grinding bodies not being fluidized within the grinding stock. The auxiliary grinding bodies start moving in the direction of the flow 29 in the grinding chamber 34, this motion leading to great strain on the grinding stock accompanied with simultaneous comminution and dispersion of the grinding stock. In a stationary condition of the agitator mill, grinding stock is sucked off by way of the device for grinding stock suction and auxiliary-grinding-body separation 32 i.e., grinding stock is sucked by the suction pump 40 in the device 32, with the pump 40 always being run at its nominal load. If the suction rate of the pump 40 exceeds the feed rate of the grinding-stock feed pump 31, the level 36 will set automatically at the upper edge of the recess 42. If the level 36 drops below the upper edge of the recess 42, air is sucked in additionally, which reduces the liquid-suction rate of the pump 40. At a reduced suction rate of the pump 40, the level 36 will again rise beyond the upper edge of the recess 42, closing it air-tight. With no air penetrating any more, the suction pump 40 will run at nominal load until the level 36 again drops below the upper edge of the recess 42. In this way level regulation takes place in the grinding chamber 34. With at best few auxiliary grinding bodies 37 penetrating into the area of the plunge pipe 33 that is located in the bed of grinding stock and auxiliary grinding bodies 37, these few auxiliary grinding bodies 37 do not move upwards in the plunge pipe 33 along with the pumped stream of grinding stock; rather they will sediment downwards. This is still supported by the fact that the flow rate of pumped grinding stock is very low in the plunge pipe 33 because of the great diameter d thereof and because the density of auxiliary grinding bodies 37 is high compared to the density of grinding stock. In addition, the grinding stock has a very low viscosity, similar to that of water. Preferably, the grinding stocks used are ceramic substances which are suspended in water, consequently being comparatively mobile. Grinding of pasty or high-viscosity liquids does not take place.

What is claimed is:

1. An agitator mill, comprising a grinding receptacle (1), which encloses a grinding chamber (34) of a diameter D, which is closed downwards by a bottom (3), which has a top cover (16) and a vertical central longitudinal axis (2);

an agitator (11), which has an agitator axis (21) that is parallel to the central longitudinal axis (1), and which is equipped with agitator implements (13) inside the grinding chamber (34);

an agitator drive (19) for rotary actuation of the agitator (11) about the agitator axis (21);

a grinding-stock supply (24) which discharges into the grinding chamber (34);

a partial filling of the grinding chamber (34) with auxiliary grinding bodies (37) of a diameter b which are movable in a bed of grinding stock and auxiliary grinding bodies in a direction of flow (29); and a device (32) for grinding-stock suction and auxiliary-grinding-body separation, which leads out of the grinding chamber (34), which comprises a plunge pipe (33) which is laterally spaced apart from the agitator to form an area where there is a strong compaction of the flow in the direction of flow (29), the plunge pipe having an inside diameter d which, by a bottom inlet (35), dips into the bed of grinding stock and auxiliary grinding bodies and from which a suction pipe (39) having a grinding-stock suction device (40) that discharges above the grinding receptacle (1)

wherein the grinding-stock supply is a grinding-stock supply line (24) that projects into the grinding chamber (34), wherein the plunge pipe (33) is disposed between the agitator (11) and the grinding-stock supply line (24), wherein the plunge pipe (33), at said bottom inlet (35), comprises a recess (42) which—related to the direction of flow (29)—is formed on the downstream side of the plunge pipe (33); and wherein an area (44) of the plunge pipe (33) which—related to the direction of flow (29) is located on the upstream side of the plunge pipe (33) in direct vicinity to the inlet (35) shields the recess (42) in the direction of flow (29), wherein the grinding stock and the auxiliary grinding bodies are sucked out of the agitator mill into the plunge pipe (33) and the auxiliary grinding bodies are segregated in the plunge pipe (33) by weight and inertia, and wherein after a grinding process the auxiliary grinding bodies that pass below the plunge pipe are entrained by gravity in the bed and are directly returned to the grinding chamber.

2. An agitator mill according to claim 1, wherein the grinding receptacle (1) is rotarily drivable by a grinding-receptacle drive (6).

3. An agitator mill according to claim 1, wherein the plunge pipe (33) is eccentric of the central longitudinal axis (2).

4. An agitator mill according to claim 1, wherein the agitator (11) is eccentric of the central longitudinal axis (2).

5. An agitator mill according to claim 1, wherein the grinding-stock supply line (24) is a flow deflector (36).

6. An agitator mill according to claim 1, wherein the inside diameter d of the plunge pipe (3) is great in relation to the diameter b of the biggest auxiliary grinding bodies (37).

7. An agitator mill according to claim 6, wherein $d \geqq 10b$, and preferably $d \geqq 20b$, applies to the diameter d of the plunge pipe (33) in relation to the diameter b of the auxiliary grinding bodies (37).

8. An agitator mill according to claim 1, wherein $10d \geqq D$ $4d$, and preferably $8d \geqq D$ $5d$, applies to the diameter D of the grinding chamber (34) in relation to the diameter d of the plunge pipe (33).

9. An agitator mill according to claim 1, wherein the plunge pipe (33) is continuously cylindrical.

10. An agitator mill according to claim 1, wherein the plunge pipe (33), in the vicinity of the inlet (35), comprises an edge (43) which ascends in the direction of flow (29).

11. An agitator mill according to claim 1, wherein an upper area (45) of the recess (42) is located in the vicinity of a top level (36) of the bed of grinding stock and auxiliary grinding bodies of the grinding chamber (34).

12. An agitator mill according to claim 1, wherein the plunge pipe (33) is skewed as compared to the vertical.

13. An agitator mill according to claim 1, wherein the grinding-stock supply is a grinding-stock supply line (24) that reaches as far as into the proximity of the bottom (3) of the grinding chamber (34).

* * * * *